United States Patent [19]

Fogg et al.

[11] Patent Number: 5,009,616

[45] Date of Patent: Apr. 23, 1991

[54] CONNECTOR ASSEMBLY WITH BACK SHELL HAVING VANES

[75] Inventors: Michael W. Fogg, Harrisburg; Leroy J. Morningstar, Middletown, both of Pa.

[73] Assignee: AMP Incorporated, Harrisburg, Pa.

[21] Appl. No.: 450,784

[22] Filed: Dec. 14, 1989

[51] Int. Cl.[5] ..... H01R 13/648

[52] U.S. Cl. ..... 439/608; 439/936

[58] Field of Search ..... 439/95, 96, 97, 98, 439/108, 607, 608, 609, 610, 936

[56] References Cited

U.S. PATENT DOCUMENTS

| | | | |
|---|---|---|---|
| 4,405,187 | 9/1983 | Müller et al. | 439/610 X |
| 4,781,615 | 8/1987 | Davis et al. | 439/395 |
| 4,824,383 | 4/1989 | Lemke | 439/608 X |
| 4,832,624 | 8/1987 | Waters et al. | 439/680 |
| 4,842,542 | 12/1988 | Davis | 439/357 |
| 4,842,543 | 6/1988 | Davis | 439/378 |
| 4,842,547 | 5/1988 | Defibaugh et al. | 439/460 |
| 4,846,727 | 7/1989 | Glover et al. | 439/608 |
| 4,875,877 | 9/1988 | Fleak et al. | 439/497 |
| 4,914,062 | 4/1990 | Voltz | 439/608 |

*Primary Examiner*—Neil Abrams
*Assistant Examiner*—Khiem Nguyen
*Attorney, Agent, or Firm*—Gerald K. Kita

[57] ABSTRACT

A shielded connector assembly 10 comprises, a terminal block 16 containing electrical contacts 18, a conductive back shell 11, a cable 39 extending through a cable receiving opening 20 of the back shell 11 with corresponding conductors 38 of the cable 39 connected to corresponding contacts 18, a series of passages 32 extend through the terminal block 16, and a corresponding series of vanes 35, 36 on the back shell 11 extend into the passages 35, 36 to separate selected contacts 18 from other contacts 18 in the terminal block 16.

6 Claims, 6 Drawing Sheets

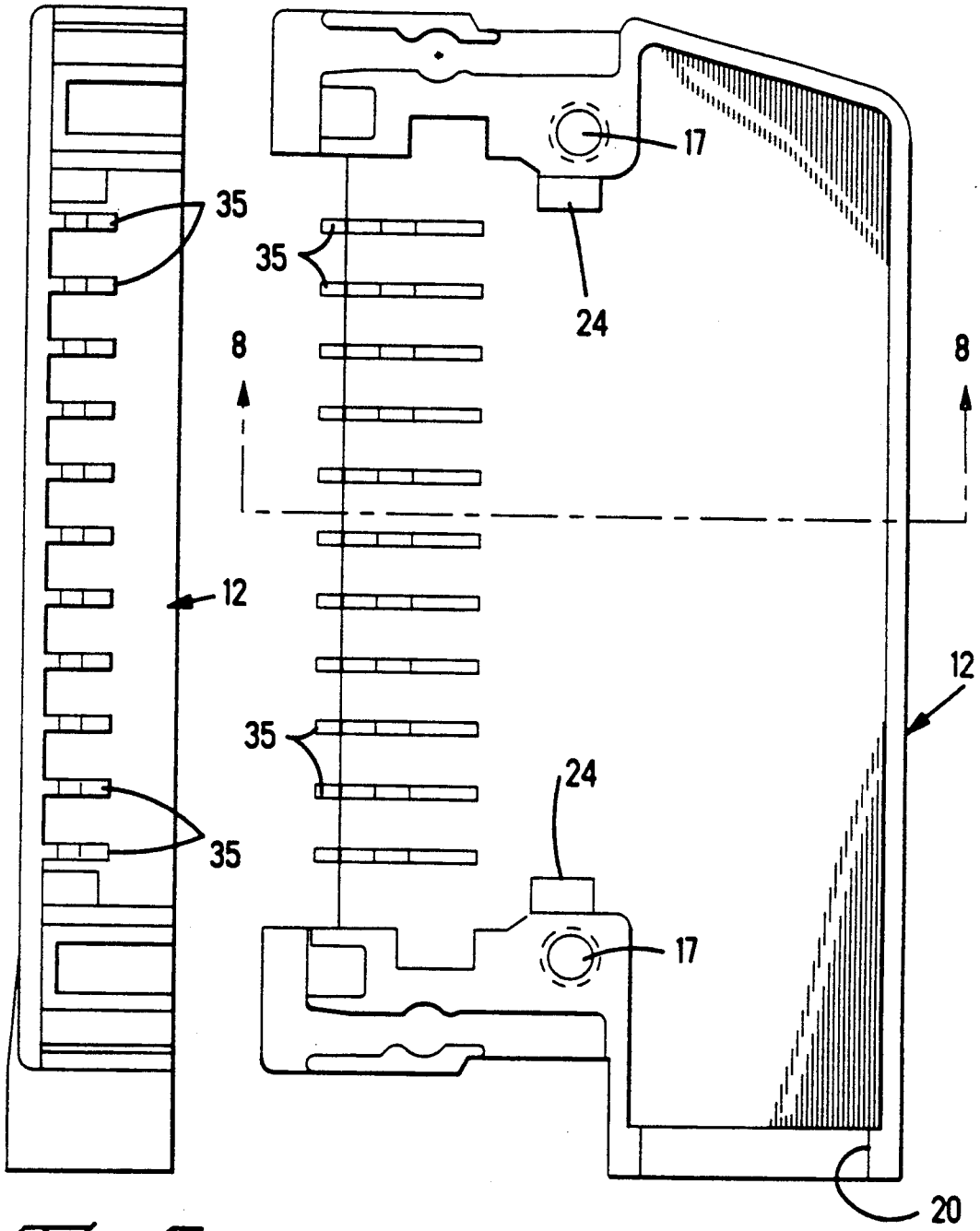
Fig. 7
Fig. 6
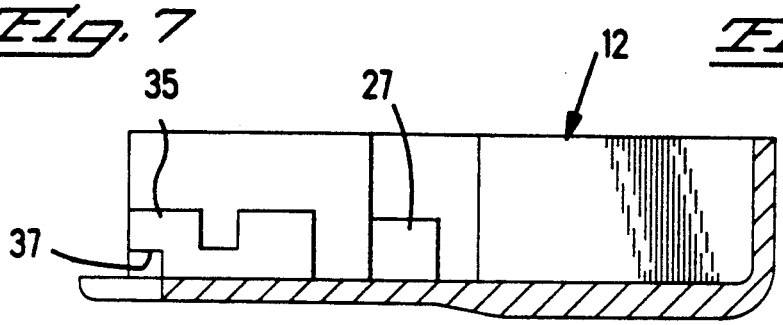
Fig. 8

CONNECTOR ASSEMBLY WITH BACK SHELL HAVING VANES

FIELD OF THE INVENTION

The specification discloses a shielded electrical connector assembly, wherein the connector assembly includes a shielded bipartite shell.

BACKGROUND OF THE INVENTION

A shielded connector assembly is known from U.S. Pat. No. 4,842,547, and includes a terminal block containing electrical contacts, a conductive back shell, a cable extending through a cable receiving opening of the back shell with corresponding conductors of the cables connected to corresponding contacts, and a strain relief for the cable contained in the back shell. The back shell is in two parts for ease in assembly over the cable and the strain relief. The back shell provides an electrical shield surrounding the conductors of the cable and the contacts.

SUMMARY OF THE INVENTION

An advantage of the invention resides in a terminal block containing electrical contacts and back shell that separates and shields selected contacts from other contacts in the terminal block. A feature that provides the advantage resides in a series of passages that extend through the terminal block and a corresponding series of vanes on the back shell that extend into the passages to separate selected contacts from other contacts in the terminal block.

Another advantage of the invention resides in a back shell that encloses and crosses through a terminal block to provide shielding through the terminal block. A feature of the invention resides in conductive vanes on both parts of a bipartite back shell extending part way through a terminal block and engaging opposing vanes to provide shielding continuously through the terminal block.

Another advantage of the invention resides in a unitary terminal block and a back shell that interlock to provide shielding extending through the terminal block in two directions, along the terminal block and across the terminal block. Closed end slots extend in the terminal block and intersect passages through the terminal block. The back shell extends along the passages and interlocks to the terminal block along the slots.

The invention will be described, by way of example, from the following detailed description taken together with the accompanying drawings.

DESCRIPTION OF THE DRAWINGS

FIG. 6 is an elevation view of a housing portion of a back shell.

FIG. 7 is a bottom plan view of the housing portion shown in FIG. 6.

FIG. 8 is a section view taken along the line 8—8 of FIG. 6.

With reference to FIGS. 1, 2 and 3, there is shown a connector assembly 10, as described in U.S. Pat. No. 4,842,547, including a conductive back shell 11 that is bipartite, with a housing 12 and a back shell cover plate 14, also called a cover, fabricated of an electrically conductive material such as die cast zinc. Cover 14 is secured to housing 12 by screws 13 passing through apertures 15 in the cover 14 and threaded into recesses 17 in the housing 12.

Within the back shell 11 is an insulative, terminal spacer block 16, also called a terminal block, having a plurality of electrical terminals !8, also called contacts, secured therein, as shown in FIG. 5. Each of the contacts 18 has a mating portion 21 and a terminating portion 19. Conductors 38 of at least one multiple conductor cable 39 are terminated to corresponding terminating portions 19, for example, by welding or soldering. Other conductors 38 of the cable 39 are terminated to a ground bus 41, and the conductors 38 and the corresponding terminating portions 19 are enclosed by insulative material 40, FIGS. 12 and 13, formed in place, before installing the terminal block 16 in the backshell in a manner disclosed in U.S. Pat. No. 4,875,877. Selected terminating portions 19 overlap tabs 42 of the ground bus 41 and are terminated thereto, as shown at 42. The ground bus 41 overlaps projections 24 on the housing 12 and projections 25 on the cover 14, and is clamped between corresponding, opposing projections 24, 25 to connect the ground bus 41 and selected contacts 18 having such terminating portions 19 to the back shell 11. A cable receiving opening 20 is located in the housing 12 as part of a strain relief system as described in Pat. No. 4,842,547. As shown in FIG. 9, a strain relief projection at an opening 22 is located in the cover 14 of the back shell 11 spaced from opening 20 for the cable 39 to pass through.

Connector 10 has a pair of pivotally mounted latch arms 14A, described more specifically in U.S. Pat. No. 4,842,542. First end 16A of each of the latch arms 14A is pressed in a direction toward the connector 10, causing spring 20A to be compressed and deflected, and causing latch end 22A to be rotated or pivoted in a direction away from the connector 1, releasing latch ear 76 from a mating connector, not shown, in a manner as described in Pat. No. 4,842,542.

Figure 1:
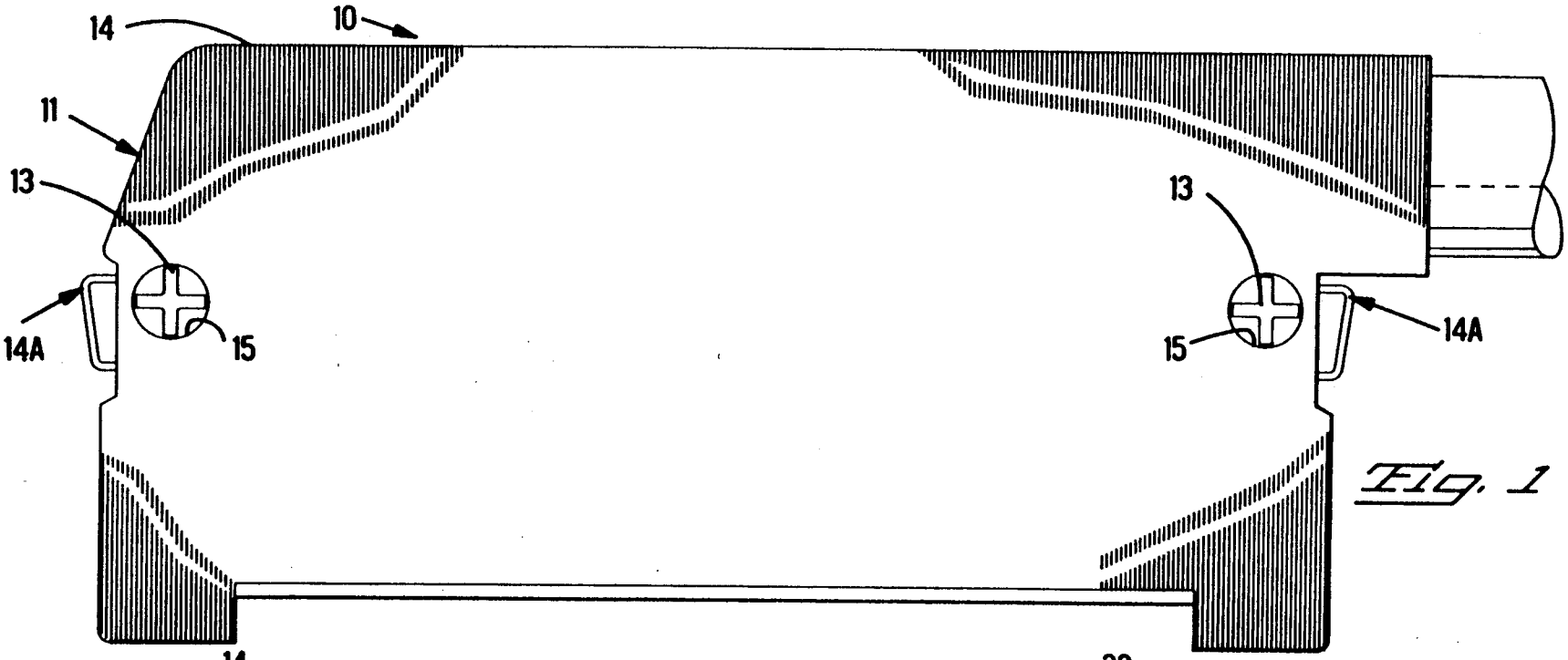
FIG. 1 is an elevation view of a shielded connector assembly with a cover in place.
Figure 2:
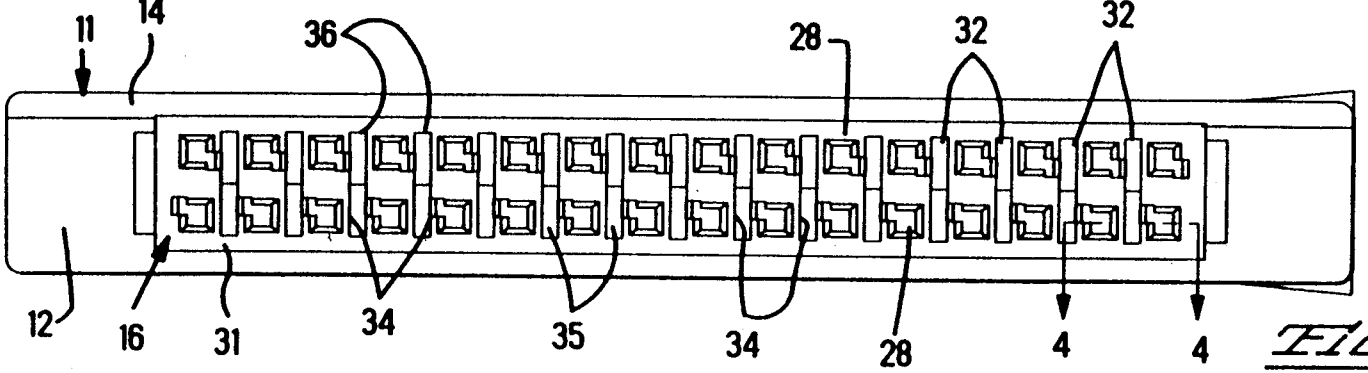
FIG. 2 is a bottom plan view of the connector assembly shown in FIG. 1.
Figure 3:
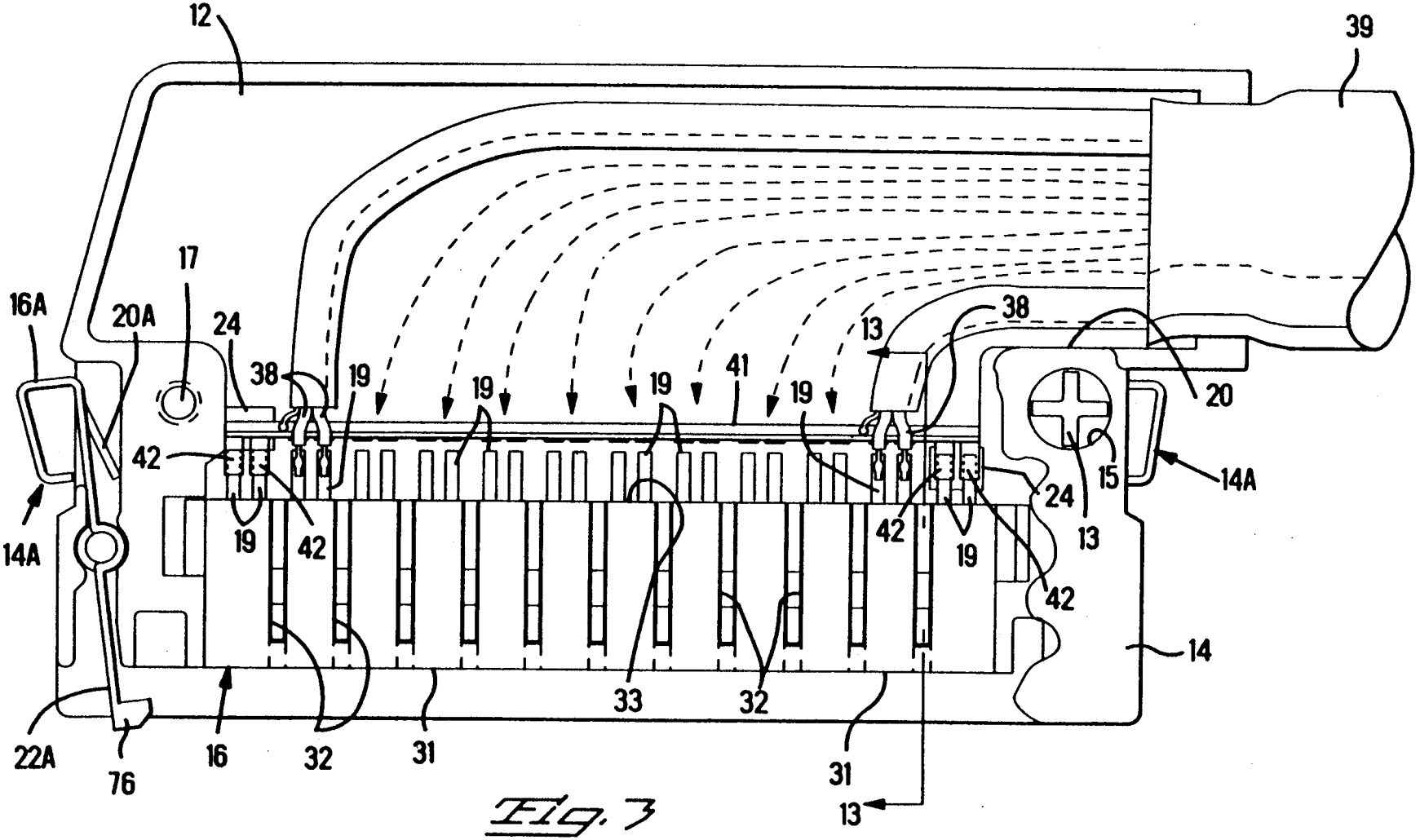
FIG. 3 is a view, similar to FIG. 1, of a shielded connector assembly with a cover removed and illustrating a terminal block.
Figure 5:
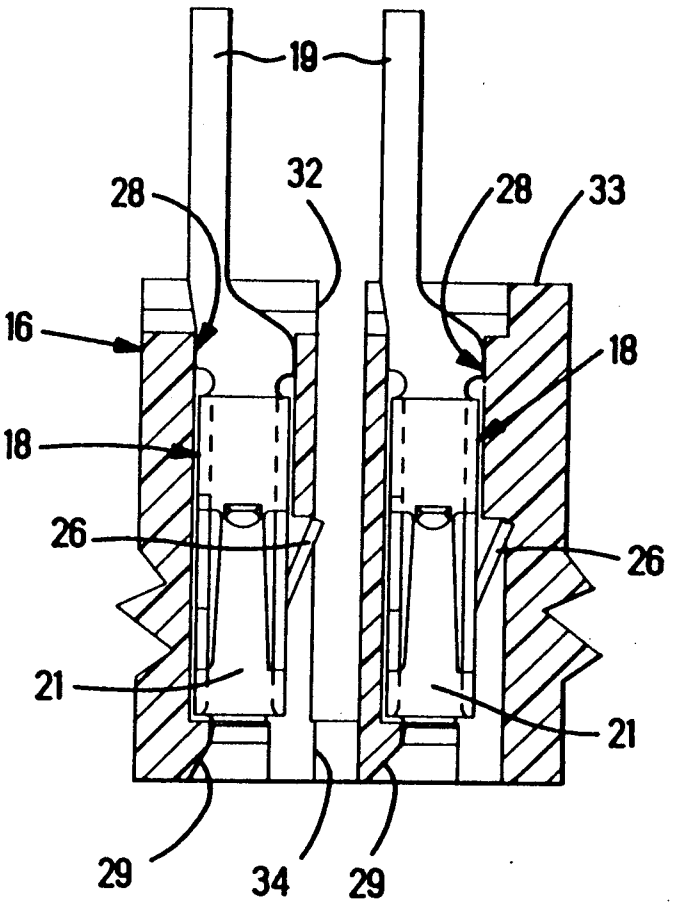
FIG. 5 is a view similar to FIG. 4 illustrating electrical contacts in the terminal block shown in FIG. 4.
Figure 4:
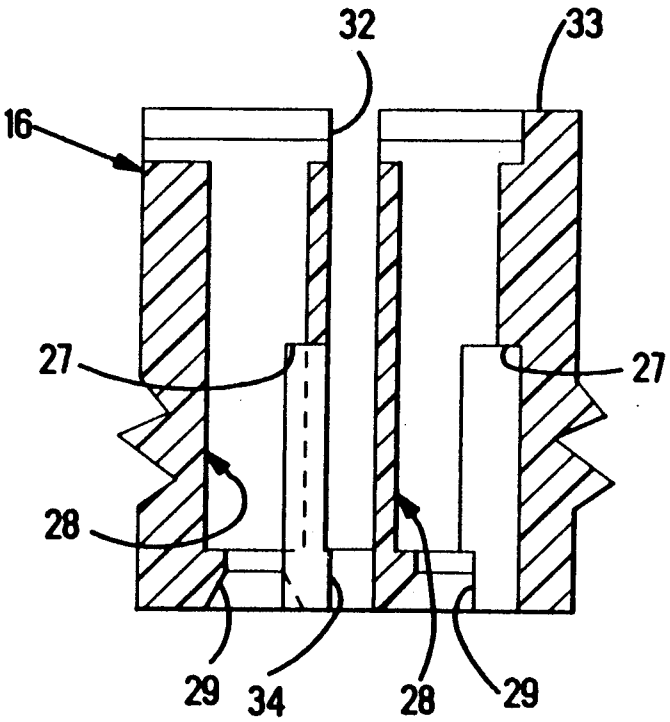
FIG. 4 is a fragmentary view in section of the terminal block shown in FIG. 3, taken along the line 4—4 of FIG. 2.
Figure 9:
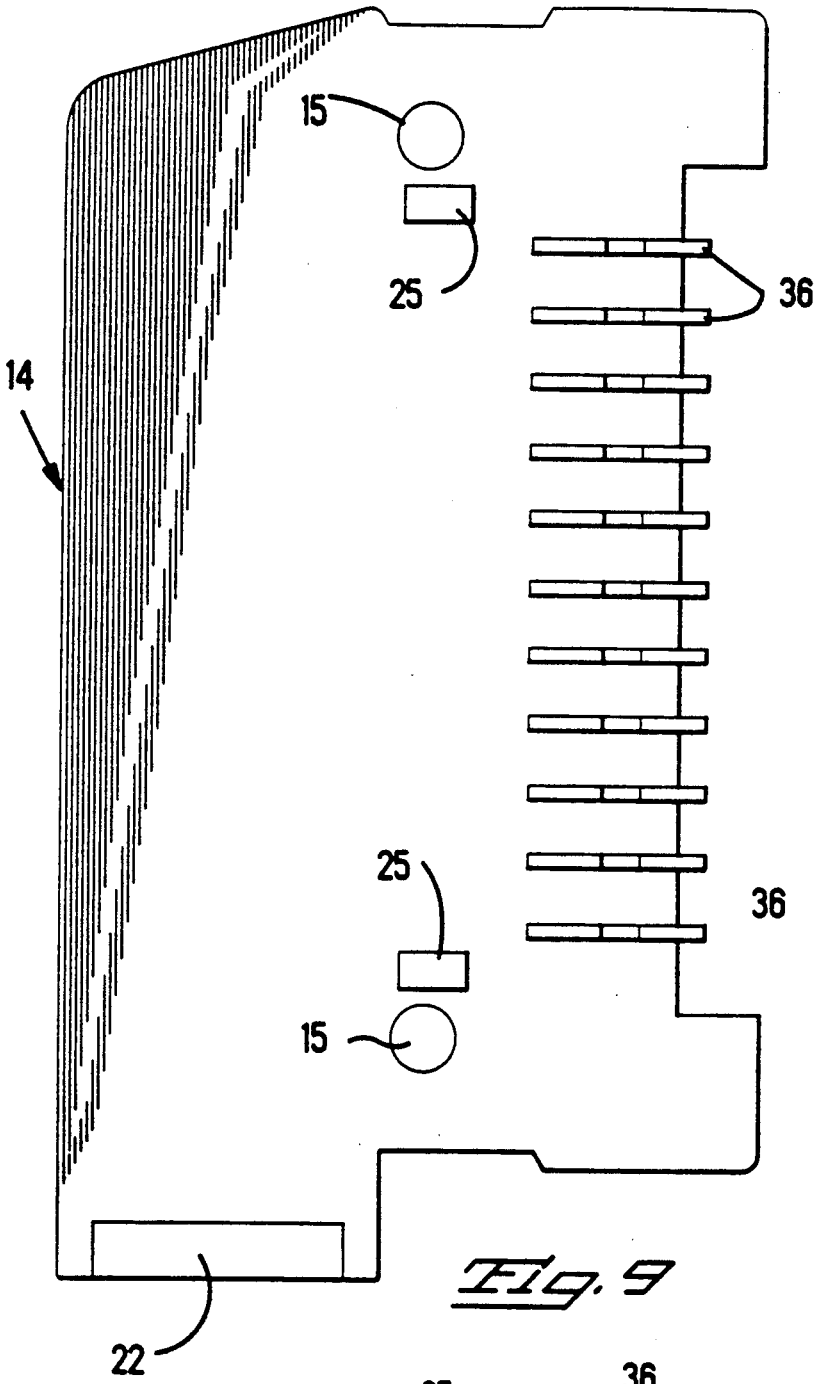
FIG. 9 is an elevation view of a cover portion of a back shell.
Figure 10:
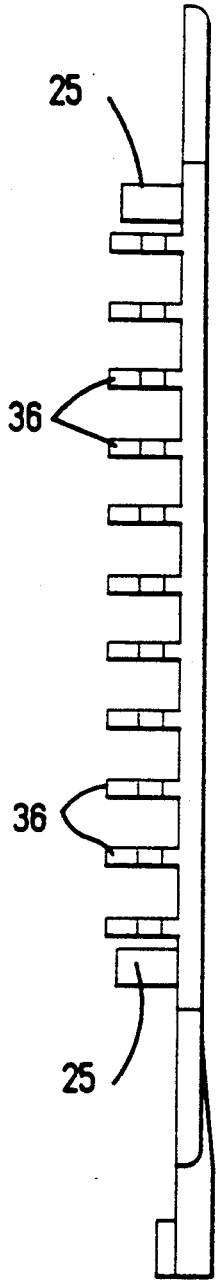
FIG. 10 is a bottom plan view of the cover portion shown in FIG. 9.
Figure 11:
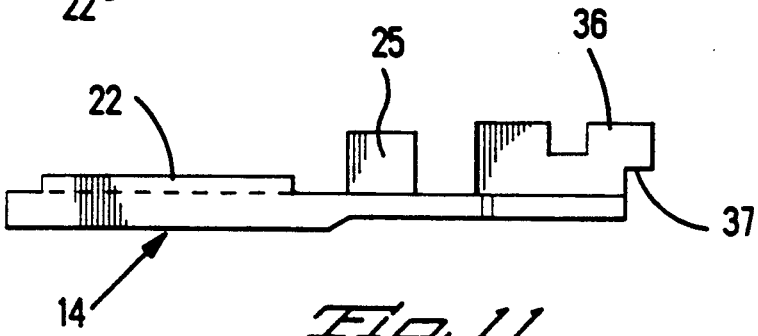
FIG. 11 is an end view of the cover portion shown in FIG. 9.
Figure 12:
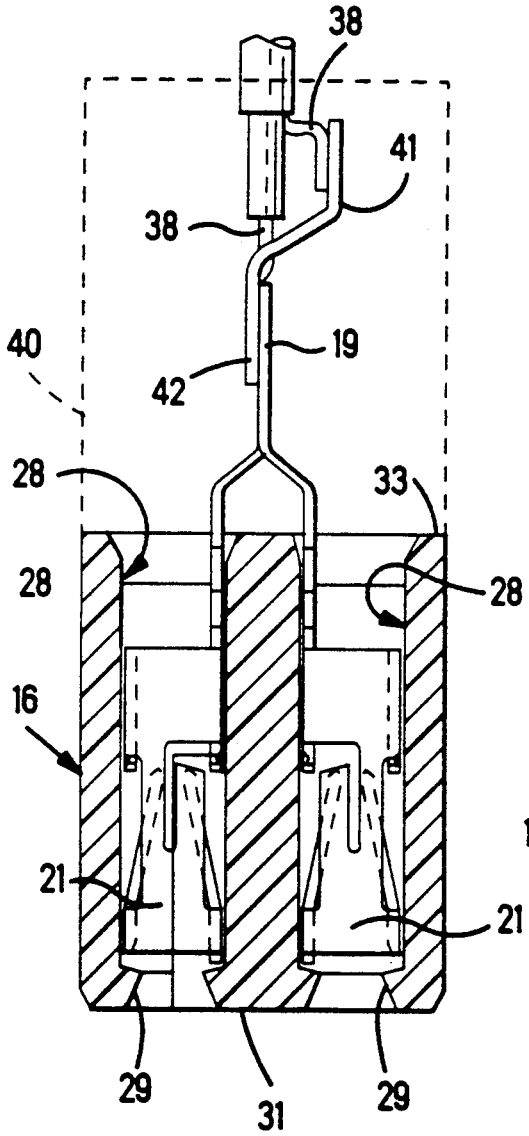
FIG. 12 is a section view similar to FIG. 5.
Figure 13:
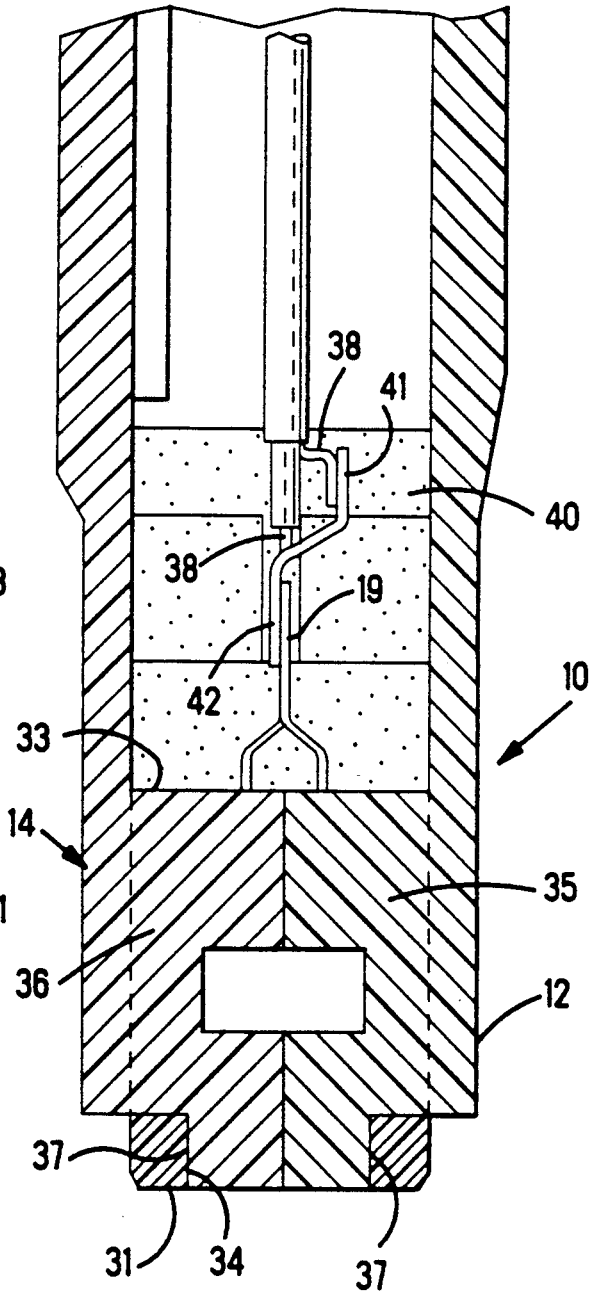
FIG. 13 is a section view taken along the line 13—13 of FIG. 3.

With reference to FIGS. 4 and 5, each of the contacts 18 includes a diagonal projecting finger 26 registering against an interior shoulder 27 of a corresponding contact receiving cavity 28 of the terminal block 16 to restrain movement of the contact 18 within the cavity 28. The mating portion 21 of each contact 18 is adjacent to an open end 29 of a corresponding cavity 28 that opens into a mating end 31 of the terminal block 16.

With reference to FIGS. 2-5, the cavities 28 are aligned in columns and rows within the terminal block 16. The columns are separated from one another by a series of passages 32 extending in a first direction, across and through the terminal block 16. The passages 32 extend through a rear end 33 of the terminal block 16 and in a second direction forwardly of the terminal block 16 to terminate short of the mating end 31 of the terminal block 16. A corresponding closed end slot 34 extends through the mating end 31, and is aligned with and intersects a corresponding passage 32. The back shell 11 is adapted to extend along the along the passages 32 and the slots 34 and to interlock to the terminal block along the slots 34. As shown in FIGS. 6–11 and 13, a series of conductive vanes 35 on the housing 12 and 36 on the cover 14, of the back shell 11 are received along corresponding passages 32 and slots 34 to separate and shield selected contacts 18 from other contacts 18 in the terminal block 16, and to enclose and cross through the terminal block 16 to provide shielding through the terminal block 16. The vanes 35 oppose corresponding vanes 36. The vanes 35, 36 extend part way through corresponding passages 32 and slots 34. The vanes 35 engage corresponding vanes 36 to provide shielding continuously through the terminal block 16 in two directions, across the terminal block 16 and from the rear through a mating end 31 of the terminal block 16. The terminal block 16 and the vanes 35, 36 of the back shell 11 interlock, with each of the vanes 35, 36 having a relieved notch 37 to interlock against respective ends of a corresponding slot 34.

We claim:

1. A shielded connector assembly comprises, a terminal block containing electrical contacts, a conductive back shell, at least one multiconductor cable extending through a cable receiving opening of the back shell with corresponding conductors of the cable connected to corresponding contacts, and a strain relief for the cable contained in the back shell, the improvement comprising;

the back shell separates and shields selected contacts from other contacts in the terminal block, the back shell is bipartite, and conductive vanes on both parts of the back shell extend part way through the terminal block and engage opposing vanes to provide shielding continuously through the terminal block.

2. A shielded connector assembly as recited in claim 1, the improvement comprising;

a series of passages extend through the terminal block, and a corresponding series of vanes on the back shell extend into the passages to separate selected contacts from other contacts in the terminal block.

3. A shielded connector assembly as recited in claim 1, the improvement comprising;

a back shell encloses and crosses through the terminal block to provide shielding through the terminal block.

4. A shielded connector assembly as recited in claim 1, the improvement comprising;

the terminal block and back shell interlock to provide shielding extending through the terminal block in two directions, across the terminal block and from a rear through a mating end of the terminal block.

5. A shielded connector assembly as recited in claim 1, the improvement comprising;

closed and slots extend in the terminal block and intersect passages through the terminal block, and the back shell extends along the passages and interlocks to the terminal block along the slots.

6. A shielded connector assembly comprises, a terminal block containing electrical contacts, a conductive back shell, at least one multiconductor cable extending through a cable receiving opening of the back shell with corresponding conductors of the cable connected to corresponding contacts, and a strain relief for the cable contained in the back shell, the improvement comprising;

the back shell separates and shields selected contacts from other contacts in the terminal block, the contacts have terminating portions projecting from a rear of the terminal block and connected to corresponding said conductors, insulative material is formed around the wire connecting portions, the back shell is bipartite, and conductive vanes on both parts of the back shell extend part of the way through the terminal block and engage opposing vanes to provide shielding continuously through the terminal block.

* * * * *

UNITED STATES PATENT OFFICE
CERTIFICATE OF CORRECTION

Patent No. 5,009,616 Dated April 23, 1991

Inventor(s) Michael Warren Fogg, Leroy Jack Morningstar

It is certified that error appears in the above-identified patent and that said Letters Patent is hereby corrected as shown below:

In Claim 5, Column 4, Line 23, the first occurrence of "and" should be changed to --end--.

Signed and Sealed this

Fifteenth Day of December, 1992

*Attest:*

DOUGLAS B. COMER

*Attesting Officer*

*Acting Commissioner of Patents and Trademarks*